US009622525B2

(12) United States Patent
Safford

(10) Patent No.: US 9,622,525 B2
(45) **Date of Patent: *Apr. 18, 2017**

(54) GLOVE WITH IMPACT GUARD

(71) Applicant: Mechanix Wear, Incorporated, Valencia, CA (US)

(72) Inventor: Kenneth Safford, Simi Valley, CA (US)

(73) Assignee: Mechanix Wear, Inc., Valencia, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/599,935

(22) Filed: Jan. 19, 2015

(65) Prior Publication Data

US 2015/0351472 A1 Dec. 10, 2015

Related U.S. Application Data

(63) Continuation of application No. 13/918,700, filed on Jun. 14, 2013, now Pat. No. 8,935,812, which is a continuation of application No. 13/156,175, filed on Jun. 8, 2011, now Pat. No. 8,490,217.

(51) Int. Cl.
*A41D 19/015* (2006.01)

(52) U.S. Cl.
CPC ..... *A41D 19/01529* (2013.01); *A41D 19/015* (2013.01); *A41D 19/01523* (2013.01)

(58) Field of Classification Search
CPC ..... A41D 19/015; A41D 19/01523; A41D 13/087; A41D 13/084; A41D 19/0006; A41D 19/01505; A41D 19/01529; A41D 13/0156; A41D 13/081; A63B 71/141; A63B 71/143
USPC .... 2/161.6, 161.1, 161.2, 161.3, 161.8, 163, 2/159, 16, 20, 164, 21, 160, 161.5
See application file for complete search history.

(56) References Cited

U.S. PATENT DOCUMENTS

| | | | | |
|---|---|---|---|---|
| 2,025,357 A | | 12/1935 | Pagan | |
| 3,348,238 A | | 10/1967 | Hydock | |
| 3,597,765 A | | 8/1971 | Stanton | |
| 3,605,117 A | * | 9/1971 | Latina | A63B 71/143 2/16 |
| 3,882,548 A | | 5/1975 | Shinagawa et al. | |
| 3,918,096 A | | 11/1975 | Lim | |
| 4,094,014 A | | 6/1978 | Schroeder | |
| D248,898 S | | 8/1978 | DeLeone et al. | |
| D268,968 S | | 5/1983 | Sami | |

(Continued)

FOREIGN PATENT DOCUMENTS

KR 3004 16270 6/2006

OTHER PUBLICATIONS

Mechanix Glove Guide 2010, vol. 18; 13 pages.

*Primary Examiner* — Amy Vanatta
(74) *Attorney, Agent, or Firm* — Knobbe Martens Olson & Bear LLP

(57) ABSTRACT

A glove has a top panel and a bottom panel that together form a main glove body. Fingers, including an index finger and other fingers, extend from the main glove body, each of the fingers having a top side and a bottom side corresponding with the top panel and bottom panels of the main glove body. A thumb extends from the main glove body. A region, at a juncture of the index finger and the main glove body on or adjacent the top panel and/or the thumb, has an insulating pad covering a portion of the region.

20 Claims, 2 Drawing Sheets

(56) References Cited

U.S. PATENT DOCUMENTS 4,484,359 A * 11/1984 Tirinen ..... A41D 19/01523 2/161.1
4,570,269 A 2/1986 Berlese
4,590,625 A 5/1986 Keim
D287,424 S 12/1986 Berlese
D288,981 S 3/1987 Hale
4,768,234 A 9/1988 Yamamoto
4,864,660 A 9/1989 Sawyer
4,911,433 A 3/1990 Walker et al.
4,930,162 A * 6/1990 Cote ..... A63B 71/143 2/16
5,067,175 A 11/1991 Gold
D328,369 S * 7/1992 Hong ..... D29/117.1
5,423,089 A 6/1995 Chun et al.
5,604,934 A 2/1997 Willett
6,185,747 B1 * 2/2001 Hughes ..... A41D 19/01505 2/161.6
6,405,380 B1 6/2002 Kuroda et al.
6,415,445 B1 7/2002 Nishijima et al.
D461,620 S 8/2002 Bevier
6,732,377 B1 5/2004 Wilkinson
D490,966 S 6/2004 Sasaki
D516,277 S 3/2006 Mattesky
7,275,268 B2 * 10/2007 Gait ..... A41D 19/01523 2/16
7,337,474 B1 3/2008 Godson
D589,678 S 4/2009 Lawrence
D604,027 S 11/2009 Kleinert
D608,978 S 2/2010 Votel
D621,553 S 8/2010 Fitzgerald et al.
D625,051 S 10/2010 Fitzgerald et al.
D653,427 S 2/2012 Wong
8,490,217 B2 7/2013 Safford
D696,467 S 12/2013 Nelson
8,935,812 B2 1/2015 Safford
2003/0051285 A1 * 3/2003 Bower ..... A63B 71/141 2/16
2006/0195968 A1 * 9/2006 Powell ..... A41D 19/01523 2/161.1
2007/0245453 A1 10/2007 Dolenak
2008/0263747 A1 10/2008 DeBlasis et al.
2009/0229035 A1 9/2009 Van Hale
2010/0083420 A1 * 4/2010 Bouckaert ..... A41D 19/01547 2/161.1
2010/0192279 A1 8/2010 Hunsicker
2011/0088139 A1 4/2011 Travell
2011/0107498 A1 5/2011 Chang

* cited by examiner

GLOVE WITH IMPACT GUARD

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

Field of the Invention

This invention relates generally to gloves, and more particularly to a protective glove that is particularly adapted for use in tight spaces.

Description of the Related Art

Protective gloves are known in the art, including gloves that include various forms of protective panels and ridges for protecting the back of the user's hand. For example, Shinagawa, U.S. Pat. No. 3,882,548, teaches a glove with protective ridges that extend down the backs of all of the fingers to a traverse region that protects the knuckles of the user. Importantly, when a glove includes such protective ridges, the extend down all of the fingers, including the index finger, and the knuckle protecting traverse region extends all the way across the back of the glove to the index finger.

The disadvantage of such a glove construction is that the protective ridges are thick enough to impede work in confined spaces. The protective ridge on the index finger, and in a region around the index finger and the thumb, especially impedes work in a confined space. The above-described reference is hereby incorporated by reference in full.

The prior art teaches protective gloves that include protective ridges on all fingers, or on none. However, the prior art does not teach a glove that includes protective ridges on fingers excluding the index finger, but leave the index finger unencumbered. The prior art also does not teach the inclusion of an insulating pad in the region, to protect the user from burns in the critical region. The present invention fulfills these needs and provides further related advantages as described in the following summary.

SUMMARY OF THE INVENTION

The present invention teaches certain benefits in construction and use which give rise to the objectives described below.

The present invention provides a glove for protecting a hand. The glove comprises a top panel for covering a back of the hand; a bottom panel for covering a palm of the hand, the top and bottom panels being connected to form a main glove body; fingers, including an index finger and other fingers, extending from the main glove body, each of the fingers having a top side and a bottom side corresponding with the top panel and bottom panels of the main glove body; and a thumb extending from the main glove body. A region, at a juncture of the index finger and the main glove body on or adjacent the top panel and/or the thumb, has an insulating pad covering a portion of the region.

A primary objective of the present invention is to provide a glove having advantages not taught by the prior art.

Another objective is to provide a glove that includes an insulating pad over a region of the glove that is particularly susceptible to injury.

A further objective is to provide a glove that includes an index finger that does not include protrusions, so that the index finger may be inserted into tight places without hindrance from the glove.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE PREFERRED EMBODIMENT

The above-described drawing figures illustrate the invention, a glove for protecting a hand of a user. The glove particularly well adapted for working in tight places, and includes a specially configured index finger having an insulating pad operatively positioned to protect the user's hand without interfering with the use of the index finger within the tight place.

Figure 1:
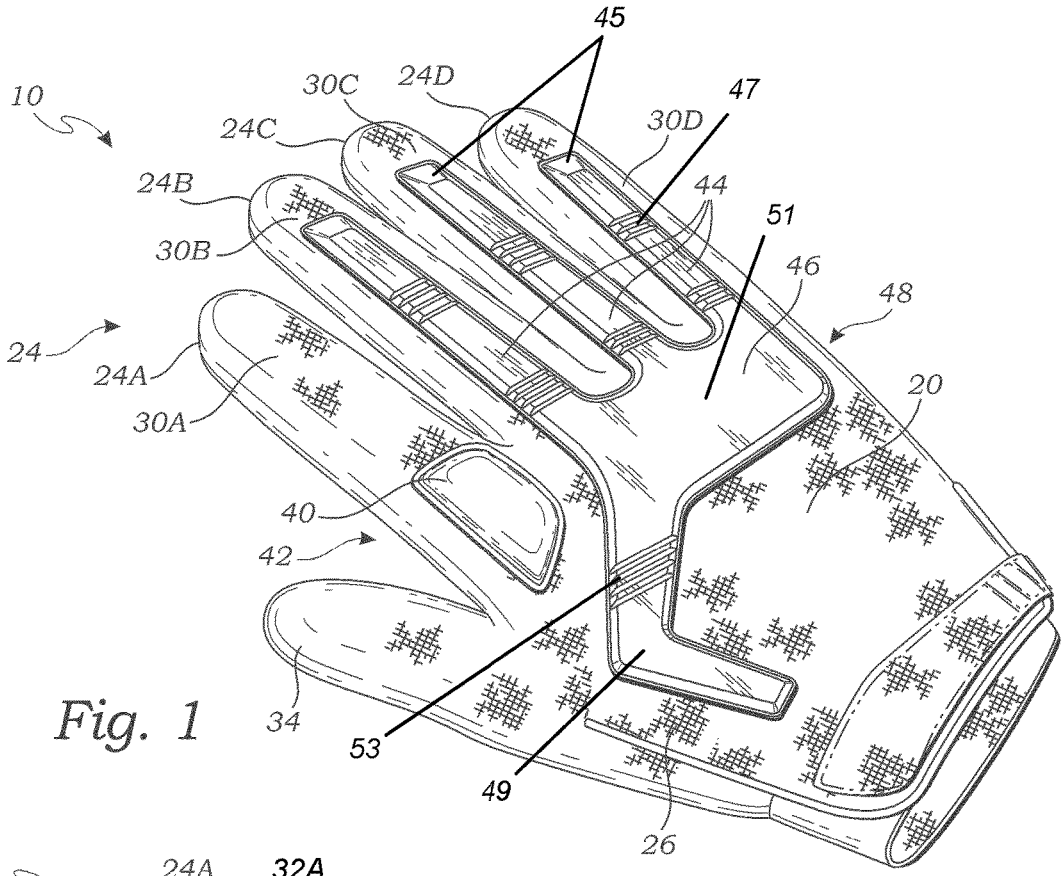
FIG. 1 is a top perspective view of a glove according to one embodiment of the present invention.
Figure 2:
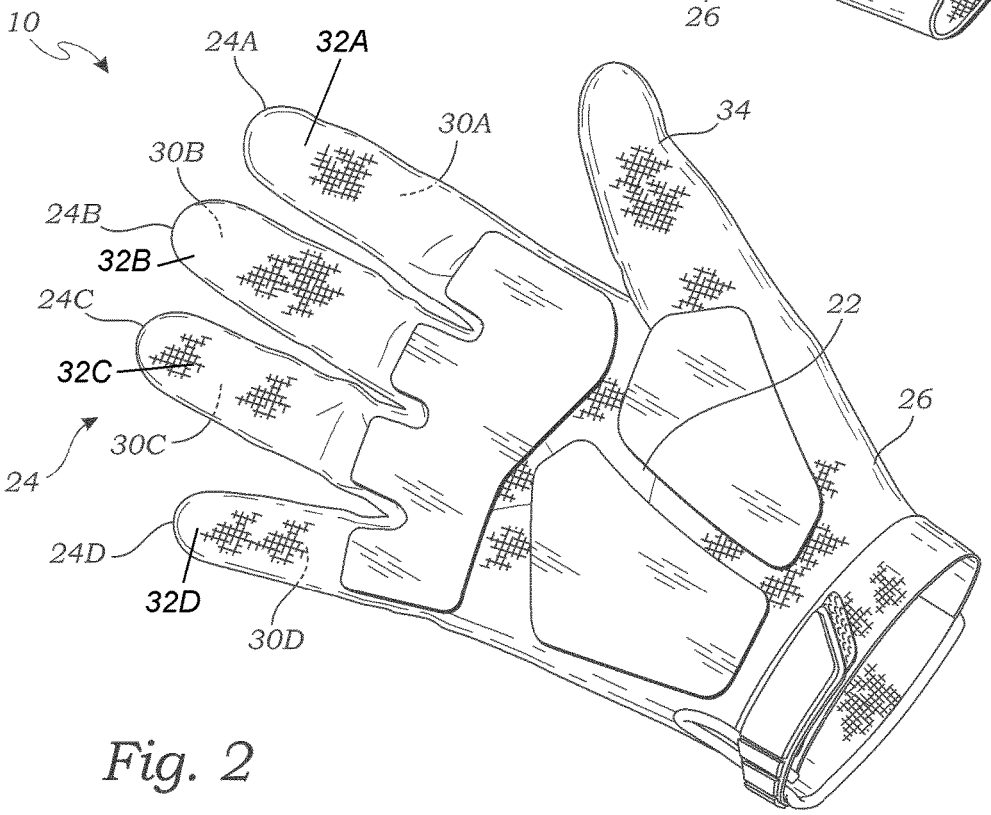
FIG. 2 is a bottom perspective view thereof.
Figure 3:
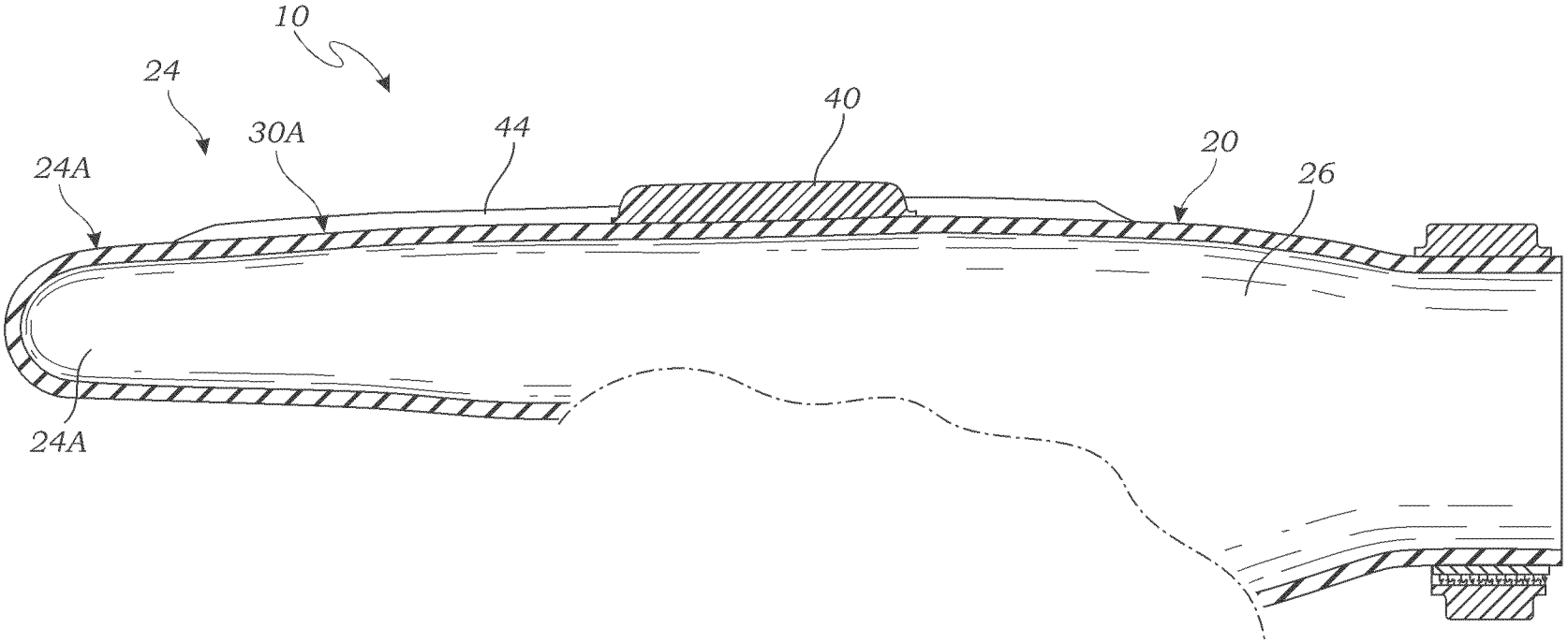
FIG. 3 is a side sectional view of an index finger of the glove, illustrating an insulating pad of the glove.

FIG. 1 is a top perspective view of the glove 10 according to one embodiment of the present invention. FIG. 2 is a bottom perspective view thereof. As shown in FIGS. 1-2, the glove 10 includes a top panel 20 for covering a back of the hand, an opposed bottom panel 22, and fingers 24. FIG. 3 is a side sectional view of an index finger 24A of the glove 10, illustrating an insulating pad 40 of the glove 10.

As illustrated in FIGS. 1-4, the top panel 20 is shaped and constructed for covering a back of the hand. The bottom panel 22 is shaped and constructed for covering a palm of the hand. The top and bottom panels 22 are connected (e.g., sewn) to form a main glove body 26. The fingers 24, including an index finger 24A and other fingers 24B, 24C, and 24D, extend from the main glove body 26 and are shaped to each receive a finger of the hand. Each of the fingers 24 includes a top side 30A, 30B, 30C, and 30D and a bottom side 32A, 32B, 32C, and 32D corresponding with the top panel 20 and bottom panels 22 of the main glove body 26. A thumb 34 extends from the main glove body 26 shaped to accommodate the user's thumb 34. The general construction of the glove 10 is similar to prior art gloves 10, and is therefore not discussed in greater detail.

Critical to the invention is the insulating pad 40 positioned within a region 42 at a juncture of the index finger 24A and the main glove body 26 on or adjacent the top panel 20 and/or the thumb 34. In one embodiment, the insulating pad 40 is a rubberized grip insert that is sewn, bonded, or otherwise attached to the region 42 of the glove 10. The insulating pad 40 is positioned to protect the user's hand from damage, and in particular from burns, when the user is inserting his or her hand into a tight location that might have elements that are hot (e.g., inside an engine, etc.). In one embodiment, the insulating pad 40 does not extend beyond the region 42, but is only positioned within the region 42 for protecting the user from injuries particular to this region 42. In the preferred embodiment, the insulating pad 40 is positioned over the proximal phalange of the user's index finger, and does not extend to the medial phalange or the metacarpal of the user's hand.

To further protect the user's hand, the glove 10 may further include thermoplastic or molded rubber protective ridges 44 extending upwardly from the top panel 20 of each of the other fingers 24B, 24C, and 24D. However, it is preferred that the index finger 24A not include such a protective ridge 44.

In the embodiment of FIG. 1, the glove 10 further includes a knuckle protector 46 extending across a knuckle region 48 of the top panel 20. The knuckle panel may be integrally formed with the protective ridges 44 of the other fingers 24B, 24C, and 24D, but preferably does not extend into the region 42 of the insulating pad 40.

In this manner, the index finger 24A of the glove 10 does not include protrusions that extend outwardly from the glove 10 in a manner that might restrict use of the glove 10 in tight spaces; and yet the insulating pad 40, carefully positioned in the region 42 specified, operates to protect the user from injury and burns in this region 42 that is particularly susceptible to injury when being used in this manner.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A protective glove adapted for working in tight places, the protective glove comprising:

a top surface configured to extend over at least a portion of a back of a hand in use and a bottom surface configured to extend over at least a portion of a palm of the hand in use, the top surface and the bottom surface extending along an index finger, a middle finger, a ring finger, and a little finger, an opening into the protective glove being defined along a top surface edge and a bottom surface edge, the opening and the index finger being separated by a main body, an insulating pad being positioned on the top surface, the insulating pad having a portion disposed on the index finger and a portion disposed just below the index finger on the main body, and at least two of the middle finger, the ring finger and the little finger includes a longitudinally-extending protective ridge, two or more of the longitudinally-extending protective ridges being interconnected by a laterally-extending protective ridge, the insulating pad being separate of and spaced apart from each longitudinally-extending protective ridge and no longitudinally-extending ridge being positioned between the insulating pad and a tip of the index finger.

2. The protective glove of claim 1, wherein the top surface is formed at least in part by a top panel and the bottom surface is formed at least in part by a bottom panel, the top panel and the bottom panel being connected in at least one location.

3. The protective glove of claim 1, wherein the insulating pad is a rubberized grip insert.

4. The protective glove of claim 3, wherein the rubberized grip insert does not extend onto any of the middle finger, the ring finger and the little finger.

5. The protective glove of claim 3, wherein the rubberized grip insert extends upwardly only sufficiently to cover the proximal phalange of an index finger of the hand when in use.

6. The protective glove of claim 3, wherein the rubberized grip insert does not extend to the medial phalange of the index finger of the hand when in use.

7. The protective glove of claim 3, wherein the rubberized grip insert does not extend to the metacarpal of the index finger of the hand when in use.

8. The protective glove of claim 3, wherein each of the middle finger, the ring finger and the little finger includes the longitudinally-extending protective ridge.

9. The protective glove of claim 8, wherein the laterally-extending protective ridge extends to a location between the insulating pad and the opening.

10. The protective glove of claim 8, wherein each of the protective ridges is narrower than the associated one of the middle finger, the ring finger and the little finger.

11. The protective glove of claim 8, wherein each of the protective ridges has a length extending at least two-thirds of a length of the associated one of the middle finger, the ring finger and the little finger.

12. The protective glove of claim 11, wherein the length of each of the protective ridges is at least three-fourths of the length of the associated one of the middle finger, the ring finger and the little finger.

13. The protective glove of claim 8, wherein a distal end of each of the longitudinally-extending protective ridges comprises a sloped edge sloping from a top surface of the longitudinally-extending protective ridges toward the top surface of the protective glove such that the distal end has a smaller thickness than a more proximal portion of the longitudinally-extending protective ridges.

14. The protective glove of claim 8, wherein each of the longitudinally-extending protective ridges includes at least one flex point.

15. The protective glove of claim 14, wherein the at least one flex point comprises a plurality of grooves formed in the longitudinally-extending protective ridge.

16. The protective glove of claim 1 further comprising a laterally-extending protector that overlies at least a portion of the top surface of the protective glove.

17. The protective glove of claim 16, wherein the laterally-extending protector is disposed between at least the middle finger and the opening.

18. The protective glove of claim 17, wherein the laterally-extending protector comprises one or more flex point.

19. The protective glove of claim 18, wherein the one or more flex point comprises a plurality of grooves.

20. A protective work glove comprising:

a top surface configured to extend over at least a portion of a back of a hand in use and a bottom surface configured to extend over at least a portion of a palm of the hand in use, the top surface and the bottom surface extending along an index finger, a middle finger, a ring finger, and a little finger, an opening into the protective work glove being defined along a top surface edge and a bottom surface edge, the opening and the index finger being separated by a main body, an insulating pad being positioned on the top surface at least partially on the main body and directly between the index finger and the opening into the protective work glove, the insulating pad comprising an insert that does not extend onto any of the middle finger, the ring finger, and the little finger, and an uninterrupted knuckle protector fully extending laterally across a knuckle region of the top surface within the main body, the knuckle protector comprising one or more flex point, the one or more flex point comprising at least one groove, the knuckle protector being positioned laterally adjacent to the insulating pad but being spaced apart from the insulating pad, and the knuckle protector being positioned between the opening into the protective work glove and each of the middle finger, the ring finger and the little finger.

* * * * *